US008888194B2

(12) United States Patent
Killion

(10) Patent No.: US 8,888,194 B2
(45) Date of Patent: Nov. 18, 2014

(54) CONTROL MODULE FOR MILLING ROTOR

(75) Inventor: Daniel H. Killion, Blaine, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 110 days.

(21) Appl. No.: 13/425,838

(22) Filed: Mar. 21, 2012

(65) Prior Publication Data

US 2013/0249271 A1 Sep. 26, 2013

(51) Int. Cl.
*E01C 23/088* (2006.01)
*E01C 23/12* (2006.01)

(52) U.S. Cl.
CPC ..... *E01C 23/088* (2013.01); *E01C 23/122* (2013.01)
USPC ..... 299/1.5; 299/39.4; 299/39.6

(58) Field of Classification Search
USPC ..... 299/1.05, 1.5, 36.1, 39.1, 39.4, 39.6
See application file for complete search history.

(56) References Cited

U.S. PATENT DOCUMENTS

| | | | | |
|---|---|---|---|---|
| 3,617,091 | A | 11/1971 | Mooney et al. | |
| 4,929,121 | A * | 5/1990 | Lent et al. | 404/84.05 |
| 5,318,378 | A | 6/1994 | Lent | |
| 5,879,056 | A * | 3/1999 | Breidenbach | 299/1.5 |
| 7,530,641 | B2 * | 5/2009 | Berning et al. | 299/1.5 |
| 2009/0108663 | A1 * | 4/2009 | Berning et al. | 299/1.5 |
| 2010/0065290 | A1 | 3/2010 | Hall et al. | |
| 2012/0179339 | A1 * | 7/2012 | Busley et al. | 701/50 |

* cited by examiner

*Primary Examiner* — David Bagnell
*Assistant Examiner* — Michael Goodwin
(74) *Attorney, Agent, or Firm* — Miller, Matthias & Hull

(57) ABSTRACT

A control module for a milling rotor of a machine is provided. The control module comprises a processor and a controller. The processor is configured to receive a first signal, indicative of a direction of motion of the machine, a second signal, indicative of a relative height of a pair of side plates with respect to the milling rotor, and a third signal, indicative of a relative height of a moldboard with respect to the milling rotor. The processor processes the first signal, the second signal, and the third signal to generate a control signal. The controller is configured to receive the control signal from the processor and selectively disengage the milling rotor of the machine based on the control signal.

20 Claims, 4 Drawing Sheets

CONTROL MODULE FOR MILLING ROTOR

TECHNICAL FIELD

The present disclosure relates to a control module, and more particularly to a control module for a milling rotor of a machine.

BACKGROUND

Control modules are provided in machines to control certain mechanisms associated with the machine. Most mechanisms present in new age machines require an intermittent check for conformity with an operational logic while the machine is in operation. For example, a cold planer having a milling rotor may require an operator to physically get down from atop the machine and check for certain operational parameters with the milling rotor before proceeding with further work. This supervision of operational parameters by the operator is very tedious and lowers the productivity of the machine. Further, if an operational parameter is not met, the machine needs to be stalled immediately to avoid any consequential damage to its components. Hence, control modules are required to intermittently control and disengage certain critical components of the machine when an operational logic is not met so that damages do not occur. Furthermore, control modules are required to maximize productivity of the machine by performing functions that were instead performed manually by the operator.

U.S. Patent Application Publication No. 2007/0286678 (U.S. Pat. No. 7,530,641) relates to an automotive construction machine for working on ground surfaces. The automotive construction machine includes a machine frame, an engine for driving traveling devices and working devices. The automotive construction machine further includes a milling drum for milling the ground surfaces, which can be raised, driven by, and can be uncoupled from a drum drive. The milling drum can be moved to a raised position when not in milling mode. When raised, the milling drum rotates and remains coupled with the drive engine. A monitoring device monitors the distance between the milling drum and the ground surface and uncouples the raised milling drum from the drive engine when the distance falls below a pre-determined distance.

SUMMARY

In one aspect, the present disclosure provides a machine comprising a power source, a milling rotor, a pair of side plates, a moldboard, a detector, a first sensor, a second sensor, and a control module. The milling rotor is operatively connected to the power source. The milling rotor includes a pair of end faces and a longitudinal axis. The pair of side plates is disposed at each of the end faces of the milling rotor. The moldboard is disposed parallel to the longitudinal axis of the milling rotor. The detector is configured to detect a direction of motion of the machine and generate a first signal. The first sensor is configured to determine a relative height of the pair of side plates with respect to the milling rotor and generate a second signal. The second sensor is configured to determine a relative height of the moldboard with respect to the milling rotor and generate a third signal. The control module includes a processor and a controller. The processor is configured to receive the first signal, the second signal and the third signal. The processor processes the first, second and third signals to generate a control signal. The controller is configured to receive the control signal from the processor and selectively disengage the milling rotor based on the control signal.

In another aspect, the present disclosure provides a control module for the milling rotor of the machine. The control module includes a processor and a controller. The processor is configured to receive and process the first, second and third signal and generate a control signal. The controller is configured to receive the control signal from the processor and selectively disengage the milling rotor of the machine based on the control signal.

In another aspect, the present disclosure provides a method of controlling the milling rotor of the machine. The method detects the direction of motion of the machine by a detector. The method generates the first signal by the detector based on the direction of motion of the machine. The method detects the relative height of the moldboard with respect to the milling rotor by the first sensor. The method generates the second signal by the first sensor based on the relative height of the moldboard with respect to the milling rotor. The method detects the relative height of the pair of side plates with respect to the milling rotor by the second sensor. The method generates the third signal by the second sensor based on the relative height of the pair of side plates with respect to the milling rotor. The method processes the first signal, the second signal and the third signal by a processor. The method generates a control signal by the processor. The method controls the milling rotor based on the control signal by a controller.

Other features and aspects of this disclosure will be apparent from the following description and the accompanying drawings.

DETAILED DESCRIPTION

Figure 1:
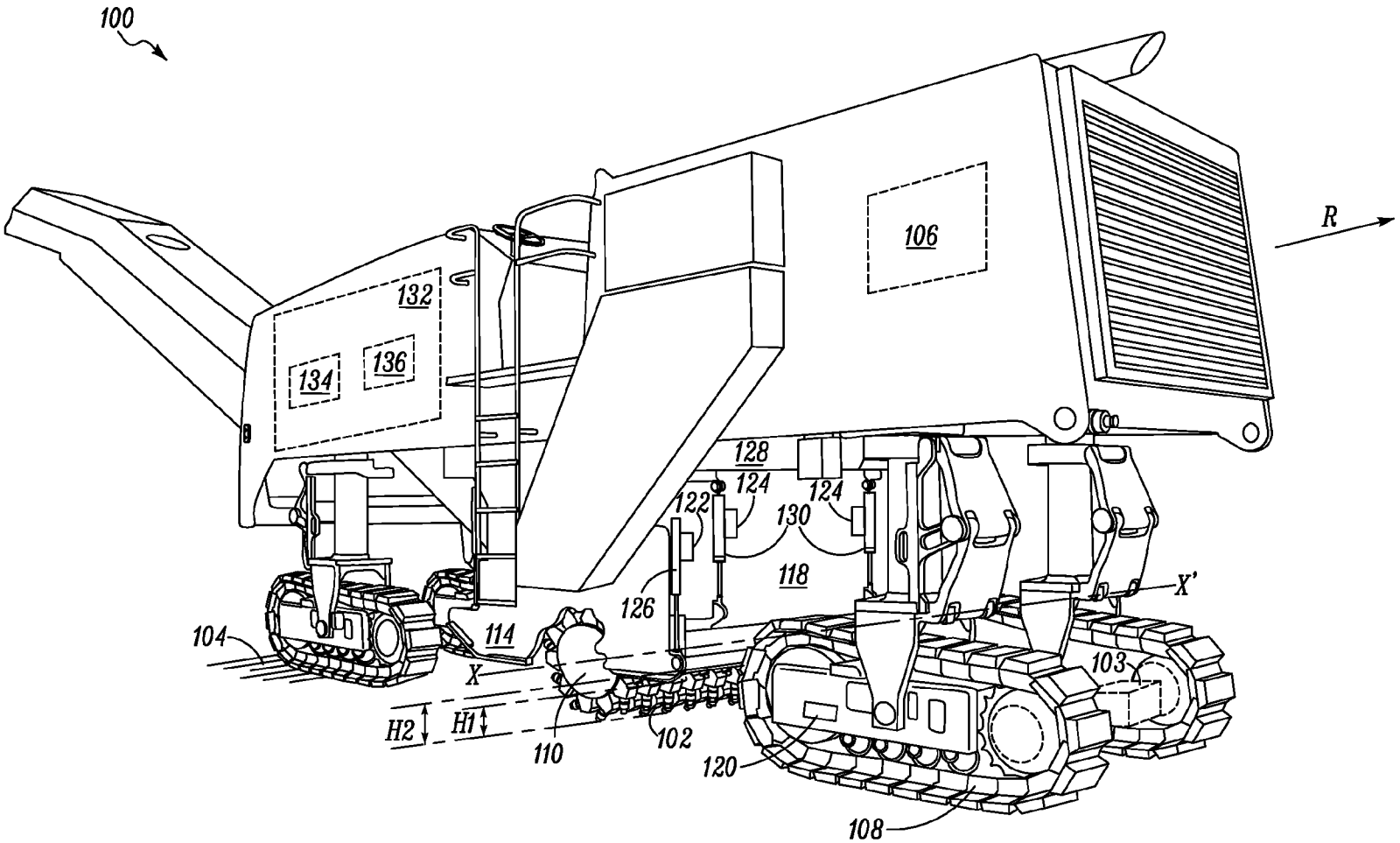
FIG. 1 is a perspective view of a machine in accordance with an embodiment of the present disclosure.
Figure 2:
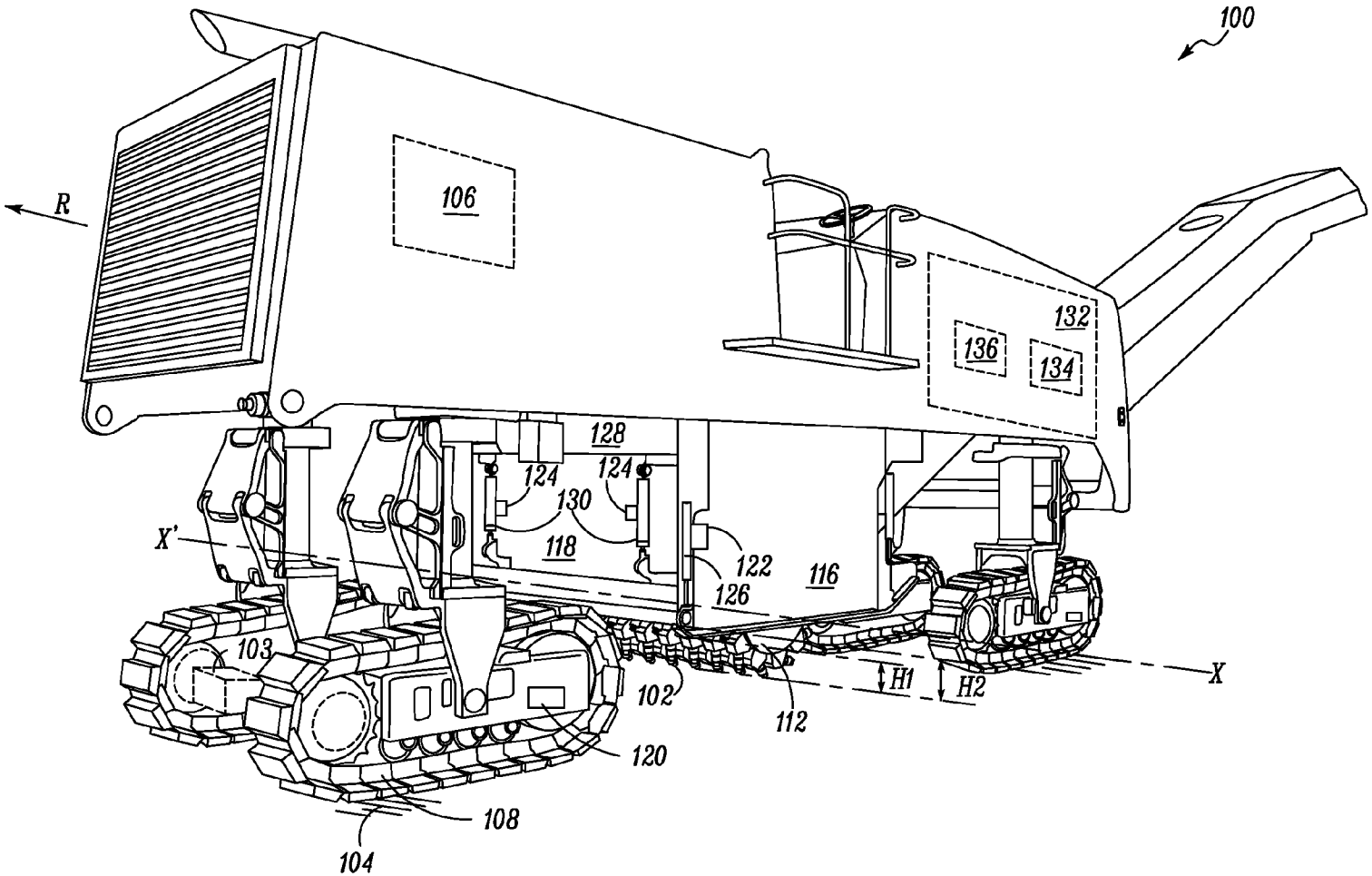
FIG. 2 is another perspective view of the machine of FIG. 1.

The present disclosure relates to a control module for a milling rotor of a machine. FIGS. 1 and 2 show perspective views of an exemplary machine 100 in which disclosed embodiments may be implemented. The machine 100 may be a wheeled or tracked industrial vehicle, for example, but not limited to, cold planers, paver machines, tracked vehicles for road compaction, milling, or the like. As shown in FIGS. 1 and 2, the machine 100 may embody a cold planer which may be used for milling soil or asphalt off the ground 104. The machine 100 includes a power source 106. The power source 106 may be a prime mover such as an engine or an electric motor that delivers power to the machine 100. The power source 106 powers a traveling system 108 via a propel system 103. The propel system 103 may transfer mechanical or electrical power to control the motion of the traveling system 108. In an embodiment, as illustrated in FIGS. 1-2, the traveling system 108 may include tracks.

The machine 100 further includes the milling rotor 102 operatively connected to the power source 106. During operation, the power source 106 drives the milling rotor 102 to mill soil or asphalt off the ground 104. The milling rotor 102 includes a pair of end faces 110, 112 positioned about a longitudinal axis X-X'. The machine 100 further includes a pair of side plates 114, 116 to substantially cover the end faces 110, 112 of the milling rotor 102. As shown in FIG. 1, a first side plate 114 is disposed adjacent to a first end face 110 of the milling rotor 102. Further, as shown in FIG. 2, a second side plate 116 is disposed adjacent to a second end face 112 of the milling rotor 102. The machine 100 further includes a moldboard 118 disposed vertically and parallel to the longitudinal axis X-X' of the milling rotor 102 as shown in FIGS. 1 and 2.

The machine 100 further includes a detector 120, a first sensor 122, and a second sensor 124. The detector 120 is configured to detect the direction of motion of the machine 100 and generate a first signal 51. In an embodiment, the detector 120 may be connected to the traveling system 108 of the machine 100. The detector 120 detects the direction of motion of the machine 100 by detecting a direction of rotation of the traveling system 108.

In another embodiment, the detector 120 may be connected to an operator joystick of the machine 100.

Further, the first sensor 122 is configured to determine a relative height H1 of the pair of side plates 114, 116 with respect to the milling rotor 102 and generate a second signal S2. In an embodiment, the first sensor 122 may be connected to a pair of primary hydraulic cylinders 126 hydraulically connecting each of the side plates 114, 116 to a frame 128 of the machine 100. In this embodiment, the first sensor 122 may detect a hydraulic expansion or retraction of the primary hydraulic cylinders 126 and hence determine the relative height H1 of the pair of side plates 114, 116 with respect to the milling rotor 102.

Similarly, the second sensor 124 is configured to determine a relative height H2 of the moldboard 118 with respect to the milling rotor 102 and generate a third signal S3. In an embodiment, the second sensor 124 may be connected to a pair of secondary hydraulic cylinders 130 hydraulically connecting the moldboard 118 to the frame 128 of the machine 100. In this embodiment, the second sensor 124 may detect a hydraulic expansion or refraction of the secondary hydraulic cylinders 130 and hence determine the relative height H2 of the moldboard 118 with respect to the milling rotor 102.

In another embodiment, the first sensor 122 and the second sensor 124 may be connected to the pair of side plates 114, 116 and the moldboard 118 respectively.

In the preceding embodiments, the detector 120 is connected to the traveling system 108, the first sensor 122 is connected to the pair of primary hydraulic cylinders 126, and the second sensor 124 is connected to the pair of secondary hydraulic cylinders 130. However, a person having ordinary skill in the art will appreciate that the connections of the detector 120, the first sensor 122, and the second sensor 124 to the traveling system 108 or the operator joystick, the pair of primary hydraulic cylinders 126 or the pair of side plates 114, 116, and the pair of secondary hydraulic cylinders 130 or the moldboard 118 is only exemplary in nature and that these connections may be accomplished with any other structures and by any known methods in the art.

Figure 3:
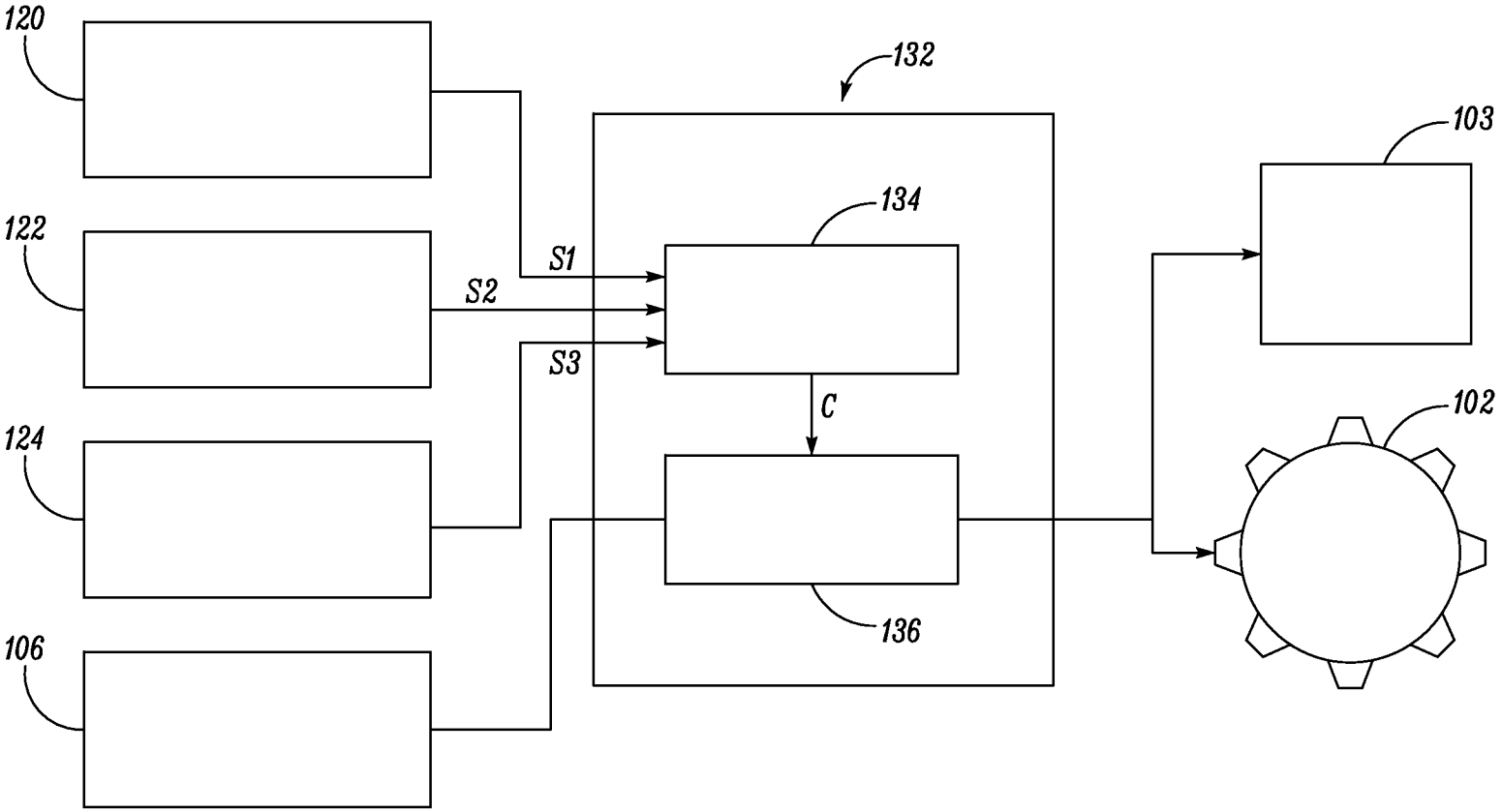
FIG. 3 is a schematic view of a control module in accordance with an embodiment of the present disclosure.

Further, the machine 100 includes a control module 132. FIG. 3 shows a schematic view of the control module 132 according to an embodiment of the present disclosure. The control module 132 may include a processor 134 and a controller 136. The control module 132 is configured to perform a host of functions in a sequential order. The processor 134 is connected to the detector 120, the first sensor 122, and the second sensor 124. The processor 134 is configured to receive a first signal S1, a second signal S2, and a third signal S3 from the detector 120, the first sensor 122, and the second sensor 124 respectively. The processor 134 processes the first signal S1, the second signal S2, and the third signal S3 to generate a control signal C. The controller 136 is connected to the power source 106, the processor 134, the milling rotor 102, and the propel system 103. The controller 136 is configured to receive the control signal C from the processor 134 and selectively disengage the milling rotor 102 or the propel system 103 based on the control signal C.

Further, the processor 134 and the controller 136 may include one or more control modules, for example ECMs, ECUs, and the like. The one or more control modules may include processing units, memory, sensor interfaces, and/or control signal interfaces for receiving and transmitting signals. The processor 134 may represent one or more logic and/or processing components used by the control module 132 to perform certain communications, control, and/or diagnostic functions. For example, the processing components may be adapted to execute routing information among devices within and/or external to the control module 132.

Industrial Applicability

As shown in FIGS. 1-2, in a mode of operation, while the machine 100 is reversing and milling soil or asphalt off the ground 104, there is a possibility that the milling rotor 102 may encounter an irregular ground surface. To protect the milling rotor 102 from any undesirable damages due to collision with the uneven ground surface, threshold limits for the relative heights H1 and H2 may have to be preset into the processor 134 of the control module 132. In an embodiment of the present disclosure, the processor 134 may store a first threshold limit and a second threshold limit, which may be different from each other. In an embodiment, the first preset threshold limit may be preset into the processor 134, for a relative height H1 between the pair of side plates 114, 116 and the milling rotor 102, at about 2 inches. Moreover, the second preset threshold limit may be also preset into the processor 134, for a relative height H2 between the moldboard 118 and the milling rotor 102, at about 2 inches.

The control module 132 is used for controlling the milling rotor 102 or the propel system 103 of the machine 100. As disclosed in the preceding embodiments, the control module 132 includes the processor 134 and the controller 136. The processor 134 is configured to receive and process the first signal S1, the second signal S2, and the third signal S3 and generate the control signal C. The controller 136 is configured to receive the control signal C from the processor 134 and selectively disengage the milling rotor 102 or the propel system 103 based on the control signal C. The control module 132 disclosed herein allows independent control of the milling rotor 102 and the propel system 103 of the machine 100. The control module 132 follows operation logic of the control signal C that is based on an independent criterion of the first signal S1, the second signal S2, or the third signal S3. In an embodiment, when the first signal S1 indicates a reverse direction of motion of the machine 100 and the second signal S2 indicates a relative height H1 difference exceeding 2 inches, the processor 134 processes the first and second signals S1, S2 and prompts the controller 136 with the control signal C to disengage the milling rotor 102 from the power source 106. In another embodiment, when the first signal S1 indicates a reverse direction of motion of the machine 100 and the third signal S3 indicates a relative height H2 difference exceeding 2 inches, the processor 134 processes the first and third signals S1, S3 and prompts the controller 136 with the control signal C to disengage the milling rotor 102 from the power source 106.

In another embodiment, the first preset threshold limit may be preset into the processor 134, for a relative height H1 between the pair of side plates 114, 116 and the milling rotor 102, at 0 inches. Moreover, the second preset threshold limit may be also preset into the processor 134, for a relative height H2 between the moldboard 118 and the milling rotor 102, at 0 inches. This implies that the milling rotor 102 may be disengaged from the power source 106 when either of the moldboard 118 or the pair of said plates 114, 116 is in line with the milling rotor 102. It should be noted that the processor 134 and the controller 136 of the control module 132 operate as per the operation logic preset into the processor 134. Any value may be preset into the processor 134 towards each of the first and second threshold limits based on which the processor 134 generates the control signal C.

Figure 4:
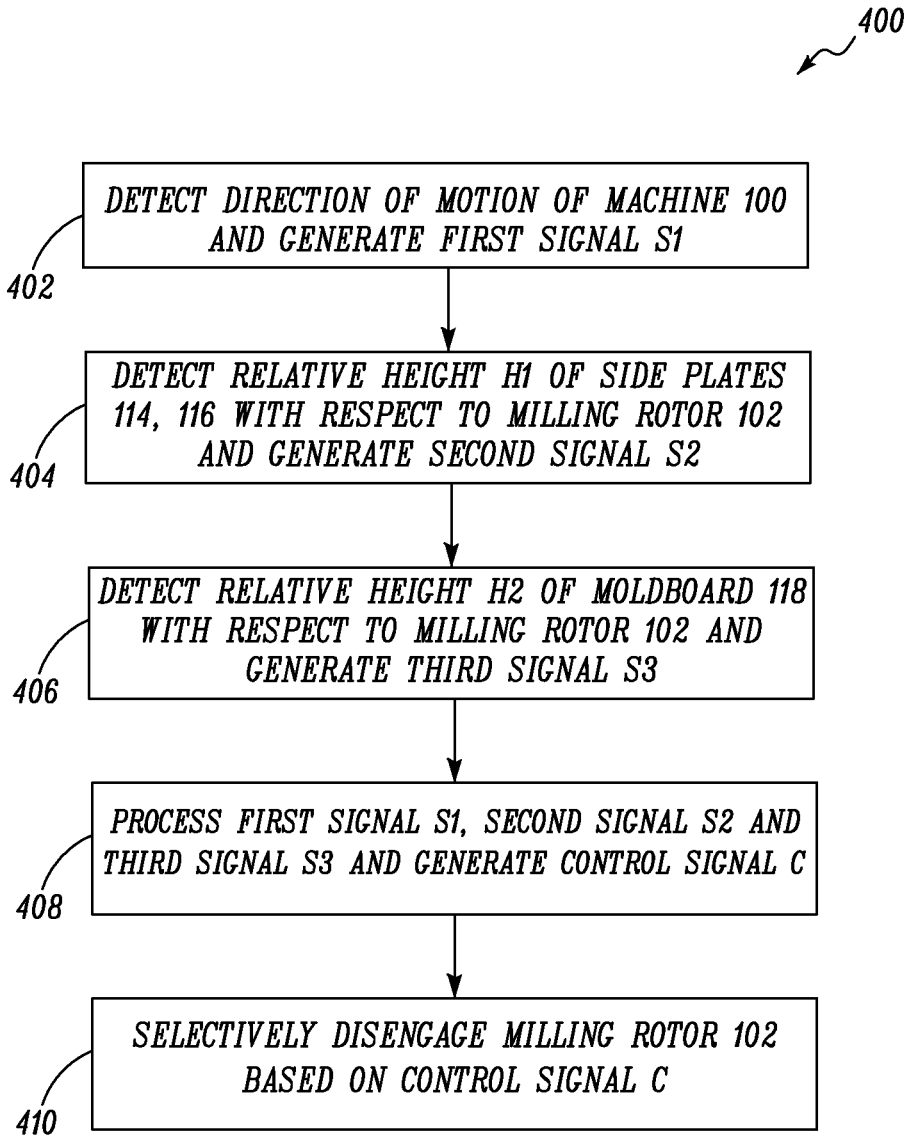
FIG. 4 is a flow diagram illustrating a control process in accordance with an embodiment of the present disclosure.

FIG. 4 shows a method 400 of controlling the milling rotor 102 of the machine 100. At step 402, the detector 120 detects the direction of motion of the machine 100 and generates the first signal S1 based on the direction of motion of the machine 100. At step 404, the first sensor 122 determines the relative height H1 of the pair of side plates 114, 116 with respect to the milling rotor 102 and generates the second signal S2 based on the detected relative height H1. Further, at step 406, the second sensor 124 detects the relative height H2 of the moldboard 118 with respect to the milling rotor 102 and generates the third signal S3 based on the detected relative height H2. At step 408, the processor 134 processes the first signal S1, the second signal S2 and the third signal S3 and generates a control signal C. At step 410, the controller 136 controls the milling rotor 102 based on the control signal C.

In an embodiment, the control signal C triggers the controller 136 to disengage the milling rotor 102 from the power source 106 when the first signal S1 is indicative of a reverse direction of motion R (as shown in FIGS. 1-2) of the machine 100 and the second signal S2 is indicative of a relative height H1 greater than the first preset threshold limit.

In another embodiment, the control signal C triggers the controller 136 to disengage the milling rotor 102 from the power source 106 when the first signal S1 is indicative of a reverse direction of motion of the machine 100 and the third signal S3 is indicative of a relative height H2 greater than the second preset threshold limit.

In an embodiment, the control signal C triggers the controller 136 to disengage the propel system 103 from the power source 106 when the first signal S1 is indicative of a reverse direction of motion R of the machine 100 and the second signal S2 is indicative of a relative height H1 greater than the first preset threshold limit.

In another embodiment, the control signal C triggers the controller 136 to disengage the propel system 103 from the power source 106 when the first signal S1 is indicative of a reverse direction of motion R of the machine 100 and the third signal S3 is indicative of a relative height H2 greater than the second preset threshold limit.

In an aspect of the present disclosure, the control module 132 maximizes machine productivity and protects the milling rotor 102 against any undesirable damage. During operation of the machine 100, the control module 132 may dynamically receive the first, second and third signals S1, S2 and S3 at predefined time intervals and automatically disengage the milling rotor 102 or the propel system 103.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

I claim:

1. A machine comprising:

a power source;

a milling rotor operatively connected to the power source, wherein the milling rotor includes a pair of end faces disposed along a longitudinal axis of the milling rotor;

a pair of side plates disposed at each of the end faces of the milling rotor;

a moldboard disposed substantially parallel to the longitudinal axis of the milling rotor;

a detector configured to detect a direction of motion of the machine and generate a first signal;

a first sensor configured to determine a relative height of the pair of side plates with respect to the milling rotor and generate a second signal;

a second sensor configured to determine a relative height of the moldboard with respect to the milling rotor and generate a third signal; and a control module including:

a processor configured to receive the first signal, the second signal and the third signal, wherein the processor processes the first, second and third signals to generate a control signal; and a controller configured to receive the control signal from the processor and selectively disengage the milling rotor based on the control signal.

2. The machine of claim 1, wherein the control signal triggers the controller to disengage the milling rotor from the power source when the first signal is indicative of a reverse direction of motion of the machine and the second signal is indicative of a relative height greater than a first preset threshold limit.

3. The machine of claim 1, wherein the control signal triggers the controller to disengage the milling rotor from the power source when the first signal is indicative of a reverse direction of motion of the machine and the third signal is indicative of a relative height greater than a second preset threshold limit.

4. The machine of claim 1 further comprising a propel system operatively connecting the power source and a traveling system of the machine, wherein the control module is configured to selectively disengage the propel system based on the control signal.

5. The machine of claim 4, wherein the control signal triggers the controller to disengage the propel system from the power source when the first signal is indicative of a reverse direction of motion of the machine and the second signal is indicative of a relative height greater than a first preset threshold limit.

6. The machine of claim 4, wherein the control signal triggers the controller to disengage the propel system from the power source when the first signal is indicative of a reverse direction of motion of the machine and the third signal is indicative of a relative height greater than a second preset threshold limit.

7. The machine of claim 1, wherein the power source is one of an engine and an electric motor.

8. The machine of claim 1, wherein the detector is disposed proximate and operatively connected to one of a traveling system and an operator joystick.

9. The machine of claim 1, wherein the first sensor is connected to a pair of primary hydraulic cylinders and the second sensor is connected to a pair of secondary hydraulic cylinders.

10. The machine of claim 1, wherein the first sensor is connected to the pair of side plates and the second sensor is connected to the moldboard.

11. A control module for a milling rotor of a machine, the control module comprising: a processor configured to receive a first signal, indicative of a direction of motion of the machine, a second signal, indicative of a relative height of a pair of side plates with respect to the milling rotor, and a third signal, indicative of a relative height of a moldboard with respect to the milling rotor, the processor processes the first signal, the second signal, and the third signal to generate a control signal based on the first signal, the second signal, and the third signal; and a controller configured to receive the control signal from the processor and selectively disengage the milling rotor of the machine based on the control signal.

12. The control module of claim 11, wherein the control signal triggers the controller to disengage the milling rotor from a power source when the first signal is indicative of a reverse direction of motion of the machine and the second signal is greater than a first preset threshold limit.

13. The control module of claim 11, wherein the control signal triggers the controller to disengage the milling rotor from a power source when the first signal is indicative of a reverse direction of motion of the machine and the third signal is greater than a first preset threshold limit.

14. The control module of claim 11, wherein the control signal triggers the controller to disengage a propel system associated with the machine when the first signal is indicative of a reverse direction of motion of the machine and the second signal is greater than a first preset threshold limit.

15. The control module of claim 11, wherein the control signal triggers the controller to selectively disengage a propel system associated with the machine when the first signal is indicative of a reverse direction of motion of the machine and the second signal is greater than a second preset threshold limit.

16. A method of controlling a milling rotor of a machine comprising:

detecting a direction of motion of the machine by a detector;

generating a first signal by the detector based on the direction of motion of the machine;

determining a relative height of a pair of side plates with respect to the milling rotor by a first sensor;

generating a second signal by the first sensor based on the relative height of the pair of side plates with respect to the milling rotor; determining a relative height of a moldboard with respect to the milling rotor by a second sensor;

generating a third signal by the second sensor based on the relative height of the moldboard with respect to the milling rotor;

processing the first signal, the second signal and the third signal by a processor;

generating a control signal by the processor based on the first signal, the second signal and the third signal; and selectively disengaging the milling rotor based on the control signal by a controller.

17. The method of claim 16, wherein the controlling the milling rotor further includes disengaging the milling rotor from a power source when the first signal is indicative of a reverse direction of motion of the machine and the second signal is greater than a first preset threshold limit.

18. The method of claim 16, wherein the controlling the milling rotor further includes disengaging the milling rotor from a power source when the first signal is indicative of a reverse direction of motion of the machine and the third signal is greater than a second preset threshold limit.

19. The method of claim 16, wherein the controlling the milling rotor further includes disengaging a propel system associated with the machine when the first signal is indicative of a reverse direction of motion of the machine and the second signal is greater than a first preset threshold limit.

20. The method of claim 16, wherein the controlling the milling rotor further includes disengaging a propel system associated with the machine when the first signal is indicative of a reverse direction of motion of the machine and the third signal is greater than a second preset threshold limit.

* * * * *